US009249980B2

(12) United States Patent
Tollar

(10) Patent No.: US 9,249,980 B2
(45) Date of Patent: Feb. 2, 2016

(54) SELF CONTAINED HEATING/COOLING ROOF TOP UNIT WITH TWO STAGE RELIEF HOOD

(75) Inventor: Greig J. Tollar, Waterloo (CA)

(73) Assignee: 2109617 Ontario Inc., Kitchener, Ontario (CA)

( * ) Notice: Subject to any disclaimer, the term of this patent is extended or adjusted under 35 U.S.C. 154(b) by 1224 days.

(21) Appl. No.: 12/943,695

(22) Filed: Nov. 10, 2010

(65) Prior Publication Data

US 2011/0111688 A1 May 12, 2011

Related U.S. Application Data

(60) Provisional application No. 61/259,830, filed on Nov. 10, 2009.

(51) Int. Cl.
*F24F 11/00* (2006.01)
*F24F 7/08* (2006.01)
*F24F 7/02* (2006.01)

(52) U.S. Cl.
CPC ... *F24F 7/08* (2013.01); *F24F 7/02* (2013.01); *F24F 2221/16* (2013.01); *F24F 2221/54* (2013.01)

(58) Field of Classification Search
CPC ..... F24F 7/025; F24F 7/02; F24F 2221/16
USPC ..... 454/228, 236, 238, 239, 255, 340, 229, 454/242, 251
See application file for complete search history.

(56) References Cited

U.S. PATENT DOCUMENTS 3,949,809 A * 4/1976 Gilles ..... F24F 3/056 165/210
4,086,781 A * 5/1978 Brody ..... F24F 11/04 165/250
4,759,196 A * 7/1988 Davis ..... F24F 1/0007 454/236
4,890,546 A * 1/1990 Venge ..... F24F 7/025 454/242
5,290,200 A * 3/1994 Kiser ..... F24F 3/044 454/229
5,346,127 A * 9/1994 Creighton ..... G05D 23/138 165/248
6,126,540 A * 10/2000 Janu ..... F24F 11/04 165/249
6,604,688 B2 * 8/2003 Ganesh ..... G05D 23/1393 165/217
7,275,533 B2 * 10/2007 Soeholm ..... F23N 3/002 126/299 R
7,625,277 B2 * 12/2009 Palmer ..... A61L 9/20 454/187
8,326,464 B2 * 12/2012 Clanin ..... F24F 11/001 454/228
2003/0111219 A1 * 6/2003 Edwards ..... F24F 3/044 165/208
2003/0181158 A1 * 9/2003 Schell ..... F24F 3/0442 454/229
2004/0253918 A1 * 12/2004 Ezell ..... F24F 11/0017 454/239
2006/0273183 A1 * 12/2006 Cavanagh ..... F24F 3/153 236/44 C
2007/0190925 A1 * 8/2007 Tollar ..... F24F 7/025 454/242
2008/0203866 A1 * 8/2008 Chamberlain ..... F24F 1/0007 312/236

* cited by examiner

*Primary Examiner* — Alissa Tompkins
*Assistant Examiner* — Jonathan Cotov
(74) *Attorney, Agent, or Firm* — Daryl W. Schnurr

(57) ABSTRACT

A self-contained air unit for installation on a roof top of a building has a pressure relief opening that is independent of the air circulation system of the unit. The air circulation system has a first blower and the pressure relief opening has a damper system that connects the pressure relief opening to ambient air through two passages. One of the passages contains a second blower to exhaust air from the air circulation system and from the independent pressure relief opening simultaneously. A two-stage pressure relief hood is provided for use with a self-contained air unit.

12 Claims, 4 Drawing Sheets

SELF CONTAINED HEATING/COOLING ROOF TOP UNIT WITH TWO STAGE RELIEF HOOD

Applicant claims the benefit of U.S. Provisional Application Ser. No. 61/259,830 filed on Nov. 10, 2009.

BACKGROUND OF THE INVENTION

1. Field of the Invention

This invention relates to a self-contained air unit for installation on a roof top of a building, the unit having a pressure relief opening that is independent of the air circulation system of the unit, the air circulation system having a first blower, the pressure relief opening having a damper system that connects the pressure relief opening to ambient air through two passages, a first passage being through a fourth damper to ambient air and a second passage being through a third damper to a passage containing a second blower to exhaust air from the air circulation system and from the Independent pressure relief opening simultaneously.

This invention further relates to a two-stage pressure relief hood for use with a self-contained air unit for installation on a roof top of a building for circulating air through the building, the unit having an air circulation system with a first blower connected to circulate air into and out of the building with a pressure relief opening that is independent of the air circulation system. The pressure relief opening has two stages, the first stage being a first passage that connects the pressure relief opening to ambient air through a fourth damper, and a second stage, being a second passage that connects the independent relief opening through a third damper to a second blower that is connected to exhaust air from the building through the air circulation system and simultaneously to exhaust air from the building through the independent relief opening.

2. Description of the Prior Art

Self-contained air units for installation on a roof top of a building for circulating air through the building are known and prior units have a first blower that is connected to a circulation system in order to circulate air into and out of the building and to introduce fresh air and exhaust stale air from the building. It is also known to have an air unit with an independent relief opening as described in US Application Publication No. US2007-0190925.

Self-contained air units are manufactured with a particular size and a cross-sectional area of the independent pressure relief opening is limited in size and is sometimes too small compared to the size of the independent relief opening required for a particular building in order to ensure that there will be no build-up of pressure in the building beyond the pressure of ambient air.

SUMMARY OF THE INVENTION

It is an object of the present invention to provide a self-contained air unit for installation on a roof top of a building for circulating air through the building in which the unit has an independent pressure relief opening that is connected to remove air from the building when air pressure within the building exceeds a pressure of the ambient air and obtaining an increased flow rate of air through the independent pressure relief opening by dividing the independent relief opening into two passages, one of which has a blower.

A self-contained air unit for installation on a roof top of a building for circulating air through the building comprises a housing having a first blower therein. The first blower is connected into a circulation system to circulate air into and out of the building. The unit has a pressure relief opening that is independent of the air circulation system, the pressure relief opening being connected into a first passage and a second passage within the unit. The first passage is connected to ambient air and the second passage is connected through a third damper to a second blower and to ambient air. The second blower is connected to remove air from the second passage and from the air circulation system to ambient air when the second blower is operating. The pressure relief opening and the first and second passages are constructed to allow air to pass through the passages from the pressure relief opening to ambient air whenever pressure of air within the building exceeds the pressure of ambient air and the second blower is not operating. The third damper and second blower provide increased pressure relief capability from the building through the pressure relief opening.

A self-contained air unit for installation on a roof top of a building for circulating air through the building comprises a housing having a first blower therein. The first blower is connected into a circulation system to circulate air into and out of the building. The unit has a pressure relief opening which is independent of the first blower and is connected to remove air from the building to ambient air when air pressure within the building exceeds a pressure of the ambient air. The unit has a second blower connected to remove air from the circulation system. The second blower is separated from the first blower by a first damper and a second damper. The second damper is located and controlled to remove some return air from the building that is circulated by the first blower. The first damper is constructed to open when the second damper is at least fifty percent closed. The second blower is controlled to operate when the first damper opens. There is a third damper that is located between the pressure relief opening and the second blower, the third damper being constructed to open whether or not the second blower is operating when pressure of air within the building exceed the pressure of ambient air. There is a fourth damper which is connected between the pressure relief opening and ambient air, the fourth damper being constructed to open when pressure of air within the building exceeds the pressure of ambient air.

A two-stage pressure relief hood is used with a self-contained air unit for installation on a roof top of a building for circulating air through the building. The unit comprises an air circulation system connected to a first blower to circulate air into and out of the building and a pressure relief opening that is independent of the air circulation system. The pressure relief hood is connected to the pressure relief opening. The relief hood has a first stage that has a first passage that connects the pressure relief opening to ambient air through the first passage and a second stage having a second passage that connects the independent relief opening through a damper into a second blower that is connected to exhaust air from the building to ambient air through the air circulation system and simultaneously through the independent relief opening when the second blower is operating and through the first and second passages when the second passage and the second passage is not operating arid air pressure within said building exceeds a pressure of ambient air.

A method of relieving pressure from a building when air pressure within the building exceeds the pressure of ambient air comprises constructing an independent relief opening in a roof top air unit that is used to circulate air into and out of the building using a first blower, constructing the relief opening to be independent of the air circulation system to exhaust air from the building through a fourth damper and first passage and through a third damper and second passage when the pressure of the air within the building exceeds ambient air and increasing a flow rate of the air through the independent relief opening by locating the second blower downstream of the third damper and operating the second blower to exhaust air through the independent relief opening at an increased flow rate when the air pressure within the building exceeds a pressure of ambient air and simultaneously to exhaust air from said air circulation system.

BRIEF DESCRIPTION OF THE DRAWINGS

FIG. 4 is a perspective view of a two-stage relief from a front right when the second blower is on;

FIG. 5 is a perspective view of a two-stage relief hood from a front left when the second blower is on.

DETAILED DESCRIPTION OF A PREFERRED EMBODIMENT

Figure 1:
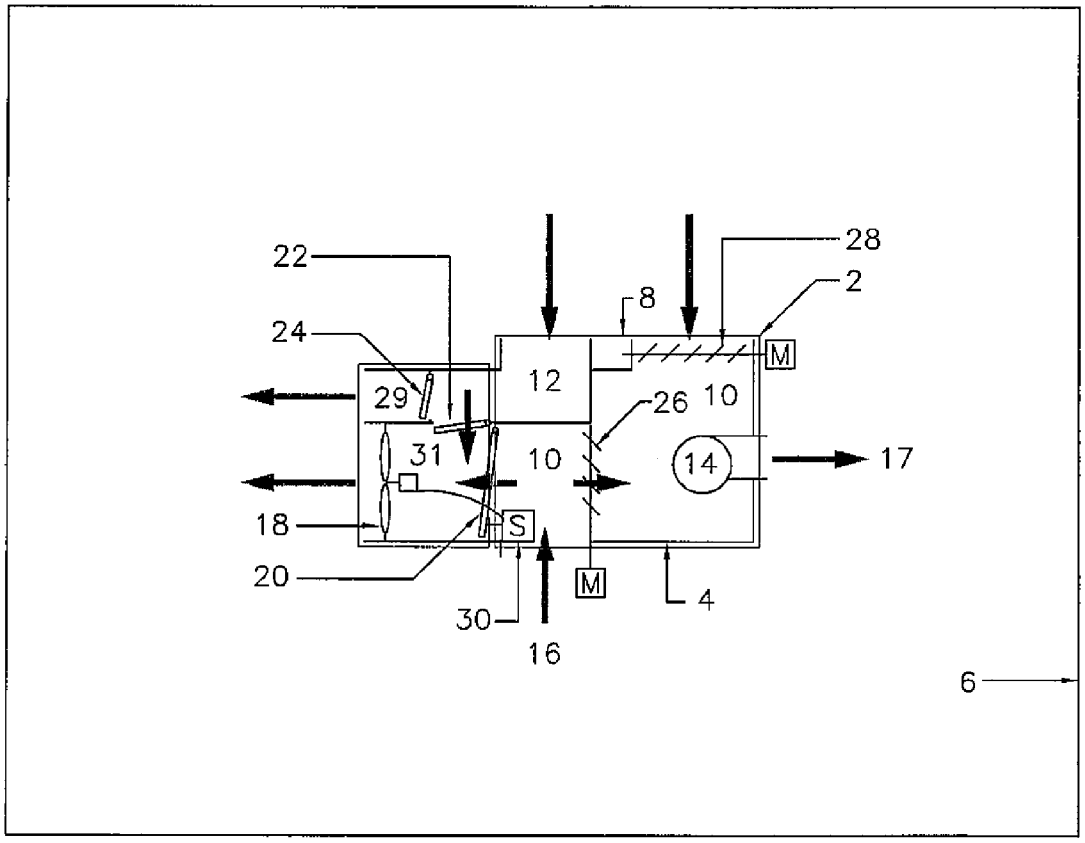
FIG. 1 is a schematic top view of a two-stage relief hood.

In FIG. 1, an air unit 2 is mounted on a roof top 4 of a building 6 to heat or cool an interior of the building 6. The unit has a condenser for heating and cooling, but the condenser is conventional and is not shown. The unit 2 has a housing 8 with an air circulation system 10 and an independent pressure relief opening 12. The air circulation system 10 has a first blower 14 and is connected into an air circulation system (not shown in FIG. 1) within the building to circulate air into and out of the building. The circulation system 10 includes an air return 16 from the building 6 and an air supply 17. The unit 2 has a second blower 18 that is connected to remove air from the circulation system and is separated from the first blower 14 by a first damper 20, which is a second stage relief damper, and a second damper 26 located between the air return 16 and the first blower 14. The first damper 20 is constructed to close when the second damper 26 is more than fifty percent open and to open when the second damper 26 is more than fifty percent closed. The second blower 18 is controlled to operate when the first damper 20 opens and to stop operating when the first damper 20 closes.

There is a third damper 22 located between the pressure relief opening 12 and the second blower 18. The third damper 22 is a relief by pass damper. The second blower 18 is connected to ambient air. The third damper 22 is constructed to open when the air pressure within the building exceeds the pressure of ambient air, whether or not the second blower 18 is operating. There is a fourth damper 24 that is connected between the pressure relief opening 12 and ambient air. The fourth damper 24 is a first stage relief damper and is constructed to open, when the air pressure within the building exceeds the pressure of ambient air, when the second blower 18 is not operating and to close when the second blower is operating. The third damper 22 and the second blower 18 provide increased pressure relief from the building 6 through the pressure relief opening 12 as the operation of the second blower causes air to flow out of the building through the independent relief opening 12 and the third damper 22 at a faster rate than when the second blower 18 is not operating. There is a fifth damper 28 located between the first blower 14 and the ambient air. Return air from the building is circulated back to the first blower 14 through the second damper 26 and fresh outside air is brought into the air circulation system 10 through the fifth damper 28. Part of the return air is removed to ambient air by the second blower 18 through the first damper 20 and replaced by the fresh outside air. The dampers 20, 22, 24, 26, 28 can each modulate between an open and closed position. First outside air through the fifth damper 28 and return air 16 through the second damper 26 mixes in a mixing plenum within the housing 8 in an area of the first blower 14.

When air pressure within the building exceeds a pressure of the ambient air, air is removed from the building through the independent relief opening 12 and through the third damper 22 or through the fourth damper 24 to the ambient air. The first blower 14 is much more powerful than the second blower 18. When the second damper 26 is more than fifty percent open the first damper 20 closes from the force created by the first blower 14. When the second damper 26 is greater than fifty percent closed, the pressure on the first damper 20 will be substantially neutral or slightly negative and will open easily. The first damper 20 preferably has a spring switch 30 thereon that causes the first damper 20 to open and the second blower 18 to operate when the pressure on the first damper 20, on the side of the first blower 14, has increased to be substantially neutral or slightly negative. The second blower 18 is connected to operate when the first damper 20 is open and to cease operating when the first damper 20 is closed. The independent relief opening 12 is connected into a first passage 29 and a second passage 31 to ambient air. The first passage 29 is a first stage relief passage and the second passage 31 is a second stage relief passage. Both passages 29, 31 are located in a two stage relief hood (best seen FIGS. 2 to 5). The first damper 20 can be controlled to open when second damper 26 is more than sixty percent closed and to open when the second damper 26 is less than sixty percent closed.

When the first blower 14 is operating, air will be circulated into and out of the building and the fifth damper 28 is controlled to introduce a pre-determined percentage of outside air to the air being circulated into the building. The first blower 14 usually operates continuously. At the same time, since fresh air is being added to the building, a similar portion of the return air is removed from the building to ambient air through the first damper 20 by the second blower 18. Air is also removed from the building through the independent relief opening 12 through the third damper 22 and past the second blower 18 to ambient air and through the fourth damper 24 to ambient air, when the second blower 18 is not operating and the air pressure within the building is greater than the pressure of ambient air.

Figure 2:
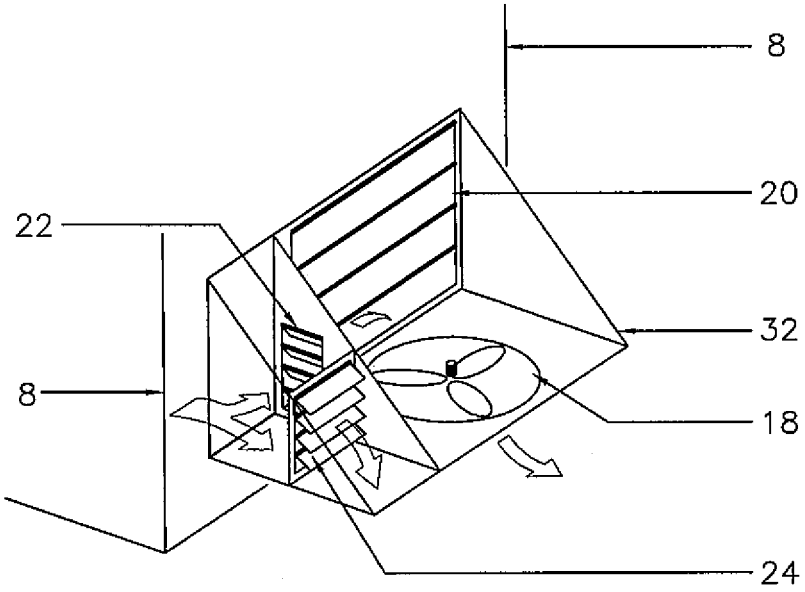
FIG. 2 is a perspective view of a two-stage relief hood from a front left when the second blower is off.
Figure 3:
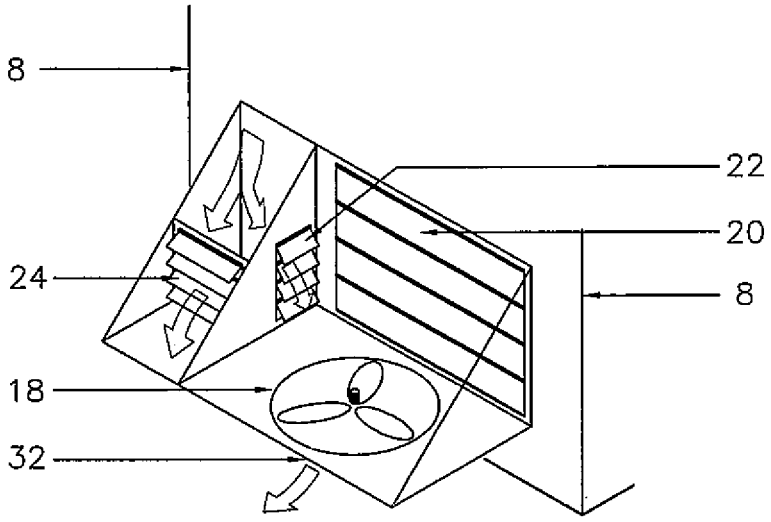
FIG. 3 is a perspective view of a two-stage relief hood from a front right when the second blower is off.
Figure 4:
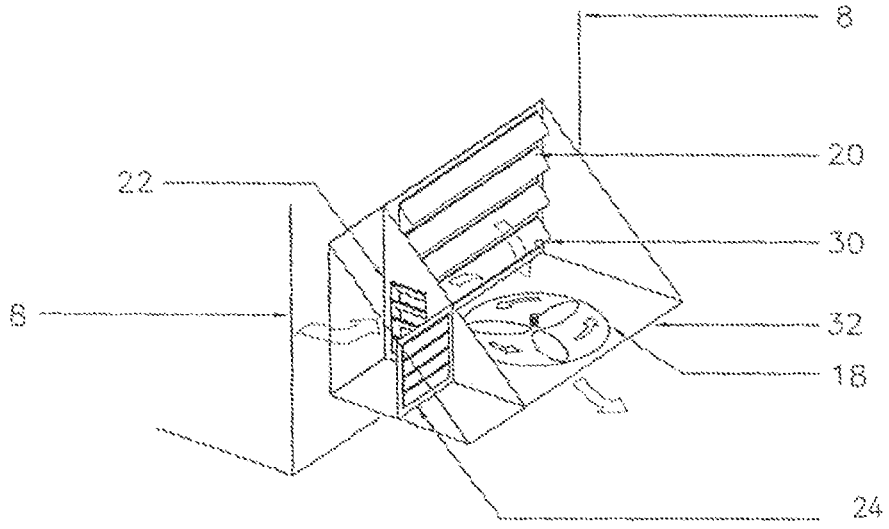
Figure 5:
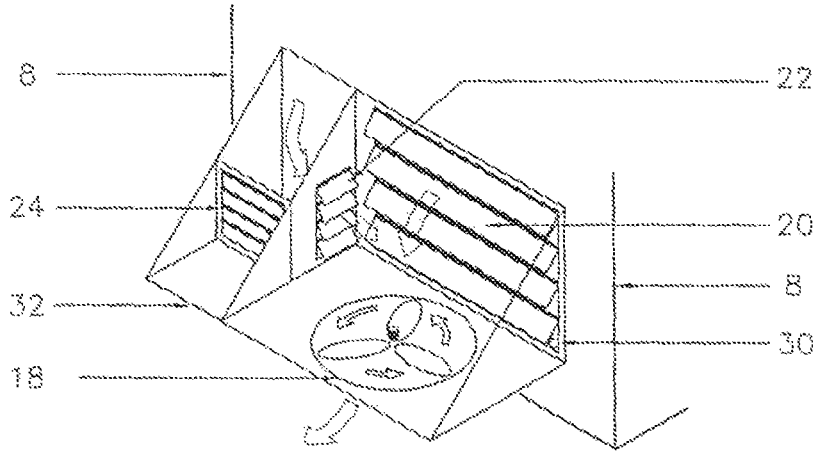

In FIGS. 2 and 3, a two-stage relief hood 32 is shown with the dampers 20, 22, 24 in a position that occurs when the second blower 18 is not operating. It can be seen that the first damper 20 is closed, the third damper 22 is open and the forth damper 24 is open. In FIGS. 4 and 5, the two-stage relief hood 32 is shown with the dampers 20, 22, 24 in a position when the second 18 blower is operating. The first damper 20 is open, the third damper 22 is also open and the fourth damper 24 is closed as the force of the second blower 18 causes the fourth damper 24 to close.

In operation, when the second blower 18 is off and the air pressure within the building is too high, air will be exhausted through the pressure relief opening 12 through the third damper 22 and through the fourth damper 24 to ambient air.

When the second blower 18 is operating as shown in FIGS. 4 and 5, the first damper 20 is open, the third damper 22 is also open and the fourth damper 24 is closed. The second blower 18 exhausts part of the return air from the building (not shown in FIGS. 4 and 5) to ambient air through the first damper 20. The third damper 22 is also open and air from the independent relief opening 12 is exhausted through the third damper 22. The same reference numerals are used in FIGS. 2 to 5 as those used in FIG. 1 for those components that are identical.

Figure 6:
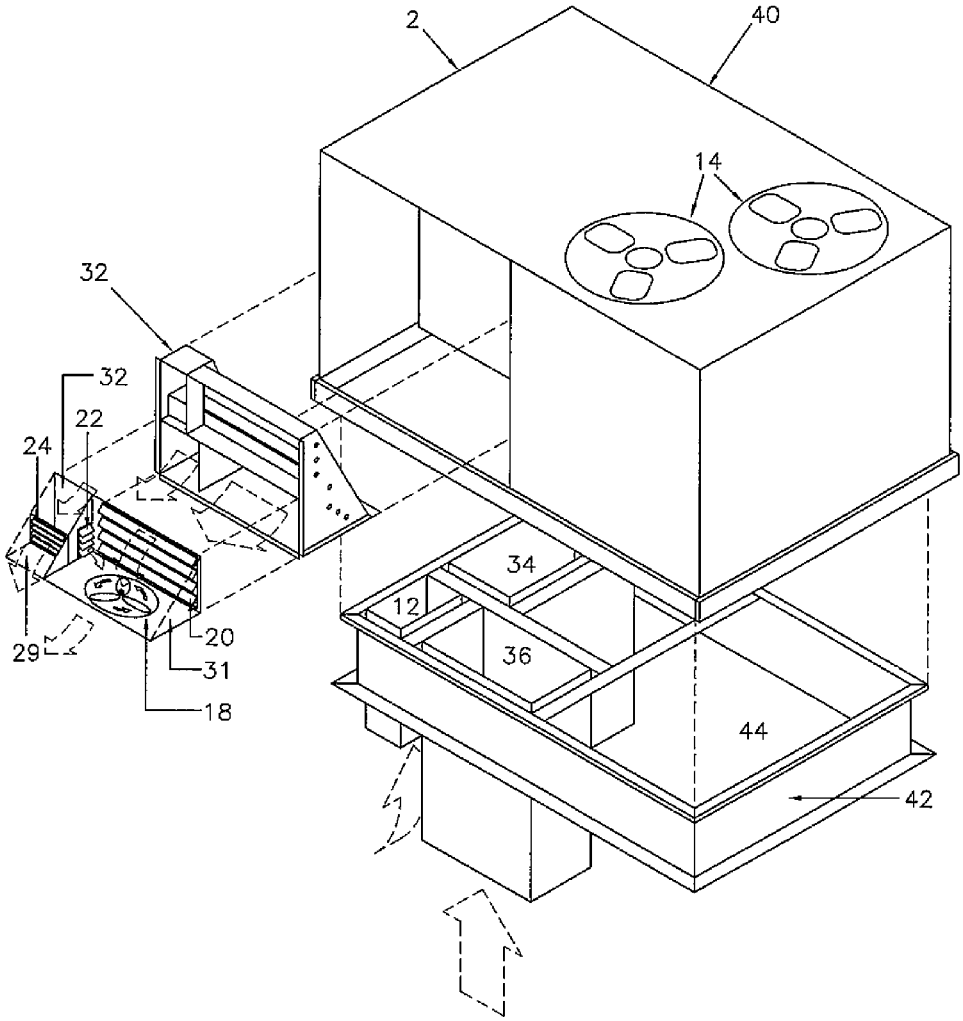
FIG. 6 is an exploded perspective view of an air unit having the two-stage relief hood thereon.

In FIG. 6, the same reference numerals are used as those used in FIGS. 1 to 5 for those components that are identical. The air unit 2 as a roof top unit contains a condenser for heating and cooling. The condenser is not shown in the drawings and is conventional. The power connections are also not shown and are conventional, The unit 2 has an air supply 34 into a building (not shown), a return air 36 from the building as well as the independent relief opening 12 from the building all located within a housing 40 of the unit 2. The independent relief opening 12 has a separate duct from the air supply 34 and the return air 36. The unit 2 has a roof curb 42 and there are two first blowers 14 and the two-stage relief hood 32. The two-stage relief hood 32 can be retrofitted to an existing air unit 2 on site or it can be installed in the air unit at the time of manufacture. The fifth damper 28 shown in FIG. 1 is located in the air unit 2 art the back of the housing 40 and is not shown in FIG. 6. The fifth damper 28 is an outside air damper and allows fresh air to enter the air circulation system 10 (see FIG. 1). The second damper 26 shown in FIG. 1 is located in the. air unit 2 between the return air inlet 36 and a mixing plenum 44. The second damper 26 is not shown in FIG. 6. Both the second damper 26 and the fifth damper 28 are conventional.

The two-stage relief hood 32 shown in FIGS. 2 and 3 is part of the air unit 2. There is a switch 30 (Not shown in FIG. 6) to energize the second blower 18 based on the effective building pressure on the second stage relief damper 20. The first damper 20 is the second stage relief damper, the third damper 22 is the relief by pass damper and the fourth damper 24 is the first stage relief damper. While the roof top air unit 2 has two first blowers 14, it can be designed to have one first blower or more than two first blowers.

I claim:

1. A self-contained air unit for installation on a roof top of a building for circulating air through said building, said unit comprising a housing having a first blower therein, said first blower being connected into a circulation system to circulate air into and out of said building, the air circulation system having the first blower connected to an air supply to the building, an air return from the building and a fresh air supply from ambient air to supply fresh air into the air circulation system, said unit having a pressure relief opening that is independent of the air circulation system, said pressure relief opening being connected into a first passage and a second passage within said unit, said first passage being connected to ambient air, said second passage being connected through a damper to a second blower and to ambient air, said second blower being connected to remove air from said second passage and from said air circulation system to ambient air when said second blower is operating, said pressure relief opening and said first and second passages being constructed to allow air to pass through said passages from said pressure relief opening to ambient air whenever pressure of air within said building exceeds the pressure of ambient air and said second blower is not operating, wherein said damper is a relief bypass damper located between said first passage and said second passage, said air circulation system having an air return from said building, said air return having a first damper located between said air return and said second blower.

2. The self-contained air unit as claimed in claim 1 wherein said air return has a second damper located between said air return and said first blower.

3. The self-contained air unit as claimed in claim 2 wherein said relief bypass damper is a third damper and said first passage has a fourth damper located therein between said pressure relief opening and ambient air.

4. The self-contained air unit as claimed in claim 3 wherein said third damper is constructed to open whenever said pressure of an air within said building exceeds the pressure of ambient air whether or not said second blower is operating and to close whenever said pressure of air within said building does not exceed the pressure of ambient air and said second blower is not operating.

5. The self-contained air unit as claimed in claim 4 wherein said fourth damper is constructed to open to ambient air whenever pressure of air within said building exceeds the pressure of ambient air and said second blower is not operating and to close when said second blower is operating.

6. The self-contained air unit as claimed in claim 5 when there is an outside air damper connected between ambient air and said first blower to allow fresh air to enter said air circulation system.

7. A self-contained air unit for installation on a roof top of a building for circulating air through said building, said unit comprising a housing having a first blower therein, said first blower being connected into a circulation system to circulate air into and out of said building, the air circulation system having the first blower connected to an air supply to the building, an air return from the building and a fresh air supply from ambient air to supply fresh air into the air circulation system, said unit having a pressure relief opening which is independent of said first blower and is connected to remove air from said building to ambient air when air pressure within said building exceeds a pressure of said ambient air, said unit having a second blower connected to remove air from said circulation system, said second blower being separated from said first blower by a first damper and a second damper, said second damper being located and controlled to receive return air from said building that is circulated by said first blower, said first damper being constructed to open when said second damper is at least fifty percent closed, said second blower being controlled to operate when said first damper opens to remove air from said second passage and from said air circulation system to ambient air, there being a third damper located between said pressure relief opening and said second blower, said third damper being constructed to open whether or not said second blower is operating when pressure of air within the building exceeds the pressure of ambient air, there being a fourth damper that is connected between said pressure relief opening and ambient air, said fourth damper being constructed to open when pressure of air within said building exceeds the pressure of ambient air and said second blower is not operating, said third damper and second blower providing increased pressure relief capability from said building through said pressure relief opening when said second blower is operating.

8. The self-contained air unit as claimed in claim 7 wherein there is a fifth damper through which ambient air can enter said air circulation system in an area of said first blower when said fifth damper is open.

9. A two-stage pressure relief hood for use with a self-contained air unit for installation on a roof top of a building for circulating air through the building, the unit comprising an air circulation system connected to a first blower to circulate air into and out of the building and a pressure relief opening that is independent of the air circulation system, the air circulation system having the first blower connected to an air supply to the building, an air return from the building and a fresh air supply from ambient air to supply fresh air into the air circulation system, the pressure relief hood being connected to the pressure relief opening, the relief hood having a first stage that has a first passage that connects the pressure relief opening to ambient air through a first passage and a second stage having a second passage that connects the independent relief opening through a damper and to a second blower that is connected to exhaust air from the building to ambient air through the air circulation system and simultaneously through the independent relief opening when said second blower is operating and through said first and second passages when said second blower is not operating and air pressure within said building exceeds a pressure of ambient air, wherein said pressure relief opening has a third passage, said third passage extending into said building and being connected to said first passage which in turn is connected to said second passage, said third passage being independent of said air circulation system.

10. The two-stage pressure relief hood as claimed in claim 9 wherein said first blower has an air supply to supply air into said building.

11. A method of relieving pressure from a building when the air pressure within the building exceeds a pressure of ambient air, the method comprising constructing an independent relief opening in a roof top air unit that is used to circulate air into and out of the building using a first blower, constructing the relief opening to be independent of the air circulation system to exhaust air from the building through a first damper and first passage and through a second damper and second passage when pressure of the air within the building exceeds ambient air and increasing a flow rate of the air through the independent relief opening by locating a second blower downstream of the second damper and operating the second blower to exhaust air through the independent relief opening at an increased flow rate when the air pressure within the building exceeds a pressure of ambient air and simultaneously to exhaust air from said air circulation system, wherein said independent relief opening has a third passage connected into said building, connecting said third passage to said first passage, which is in turn connected to said second passage.

12. A method is claimed in claim 11 wherein said first blower has an air return from said building and an air supply to said building, said method including the steps of constructing said return air and said supply air to be independent of said third passage.

* * * * *